United States Patent [19]

Ogata et al.

[11] Patent Number: 4,878,982

[45] Date of Patent: Nov. 7, 1989

[54] APPARATUS FOR SPLICING A REPLACEMENT WEB TO A WEB HAVING A PROGRAMMED MOVEMENT WITHOUT INTERRUPTING SUCH MOVEMENT

[75] Inventors: Taizo Ogata; Toyoharu Takahashi, both of Chiba; Kenji Koshiba, Tokyo, all of Japan

[73] Assignees: Tokyo Automatic Machinery Works, Ltd.; Japan Tobacco Inc., both of Tokyo, Japan

[21] Appl. No.: 137,571

[22] Filed: Dec. 24, 1987

[30] Foreign Application Priority Data

Dec. 25, 1986 [JP] Japan ..... 61-312563

[51] Int. Cl.[4] ..... B65H 19/20; B65H 21/02

[52] U.S. Cl. ..... 156/361; 156/159; 156/304.3; 156/364; 156/505; 156/541; 156/571

[58] Field of Search ..... 156/504, 505, 506, 304.3, 156/521, 541, 361, 364, 542, 362, 363, DIG. 33, 571, 159

[56] References Cited

U.S. PATENT DOCUMENTS

| | | | |
|---|---|---|---|
| 2,586,563 | 2/1952 | Rieger | 156/DIG. 33 |
| 4,067,760 | 1/1978 | Nelson | 156/505 |
| 4,189,337 | 2/1980 | Higgins et al. | 156/351 |
| 4,278,489 | 7/1981 | Horsley | 156/541 |
| 4,555,281 | 11/1985 | Mattei et al. | 156/504 |
| 4,675,069 | 6/1987 | Mattei et al. | 156/521 |

*Primary Examiner*—Michael Wityshyn

*Attorney, Agent, or Firm*—Sandler & Greenblum

[57] ABSTRACT

Automatic splicing apparatus includes a first supply containing a first web and a second supply containing a second web. An operable puller is engaged with the first web for withdrawing the same from the first supply and moving the first web along a predetermined path. Cutters are provided for establishing a trailing end on the first web and a leading end on the second web. The presence of the trailing end in the predetermined path is detected and a splicing station is positioned in the path for butt-splicing the leading edge of the second web to the trailing end of the first web in response to detecting the presence of the trailing edge, all without interrupting operation of the puller.

21 Claims, 3 Drawing Sheets

APPARATUS FOR SPLICING A REPLACEMENT WEB TO A WEB HAVING A PROGRAMMED MOVEMENT WITHOUT INTERRUPTING SUCH MOVEMENT

TECHNICAL FIELD

This invention relates to apparatus for splicing a replacement web to a web having a programmed movement without interrupting such movement, such apparatus finding application in connection with automatic packaging equipment.

BACKGROUND ART

Material used in packaging products is often supplied to a packaging line in webs spooled on reels. At the packaging line, the web is severed into segments that are sequentially applied to packages as the latter pass down the line. The web often contains a repeating pattern, and severing occurs between separate patterns such that each severed segment contains the pattern located at a precise position on the segment. Thus, when a segment is applied to a package, it is aesthetically pleasing because every segment on every package has exactly the same appearance.

The depletion of a reel containing a patterned web supplied to high speed automatic packaging equipment requires the trailing edge of the web to be quickly and accurately spliced to the leading edge of a web contained in a replacement reel such that the pattern-pitch is maintained at the splice. Conventionally, a splice is achieved by manually applying to the joint between the webs, a strip of tape having an adhesive on one surface. The problem with this conventional approach is two fold: (1) the manual nature of the splice requires constant supervision of the status of the reel in use and the presence of a worker to effect the splice when needed; and (2) the presence of a pattern on the web requires careful cutting by a worker of the trailing end of the exhausted web and the leading end of the replacement web so that the patterns match. Often, the solution to these problems requires the packaging line to be shut down while a splice is effected in order to ensure that a proper splice is made and the pattern in the replacement web is properly located relative to the pattern in the exhausted web.

It is therefore an object of the present invention to provide a new and improved apparatus for ameliorating the problems found in the prior art as discussed above by providing an automatic connection system that ensures a proper splice.

DISCLOSURE OF INVENTION

Apparatus according to the present invention includes a first web supply containing a first web, and a second web supply containing a second web. Operable pulling means is engaged with the first web for withdrawing the same from the first supply and moving the first web along a predetermined path. Cutter means are provided for severing the first web to establish a trailing edge thereon, and for severing the second web to establish a leading edge thereon. Means are also provided for detecting the presence of the trailing edge of the first web along the predetermined path. Finally, the apparatus includes a splicing station positioned in the path for splicing the leading edge of the second web to the trailing edge of the first web in response to detecting the presence of the trailing edge, all without interrupting operation of the pulling means.

According to the present invention, the splicing station is constructed and arranged to effect a splice in which the leading edge of the second web abuts the trailing edge of the first web.

When the webs have patterns that repeat in the lengthwise direction of the web, the leading and trailing edges of the webs are selected to fall precisely in the middle of a pattern so that, when the trailing edge is abutted to the leading edge, the butt connection of the two webs establishes a complete pattern, and the pattern in the second web is accurately located with respect to the pattern in the first web. In this manner, the packaging equipment utilizing the web will properly position the pattern on a package.

In the preferred embodiment of the invention, the splice by which the two webs are connected includes a splice strip that overlies and is adhesively connected to both the first and second webs at the butt joint formed by the leading and trailing edges of the webs. The splice strip preferably includes a substrate having a self-adhesive layer on one surface engaged with the webs.

In order to automatically supply splice strips to effect splices between webs, the splicing station includes a splice supply containing a carrier web, one surface of which carries a plurality of splice strips that are oriented in a direction transverse to the length of the carrier web, and that have self-adhesive on one face by which the strips are releasably attached to the carrier web. In addition, the splice station includes transfer means constructed and arranged to remove a strip from the carrier web and place the removed strip over the butt connection between the leading edge of the second web and the trailing edge of the first web with the one face of the strip in contact with the two webs.

The transfer means may include a take-up reel on which the carrier web is spooled after the splice strips are removed, a guide engaged with the carrier web effective to separate a splice strip from a portion of the carrier when such portion engages the guide, and means to power the takeup reel in timed response to detection of the trailing edge of the first web for separating a splice strip from the carrier web. The transfer means may also include a transfer mechanism having an articulated member constructed and arranged to releasably grip a splice strip separated from the carrier web and move the same into engagement with the leading edge of the second web when it abuts the trailing edge of the first web such that the self-adhesive face of the splice strip faces the abutting webs.

BRIEF DESCRIPTION OF THE DRAWINGS

An embodiment of the present invention is disclosed in the accompanying drawings wherein.

BEST MODE FOR CARRYING OUT THE INVENTION

Figure 1:
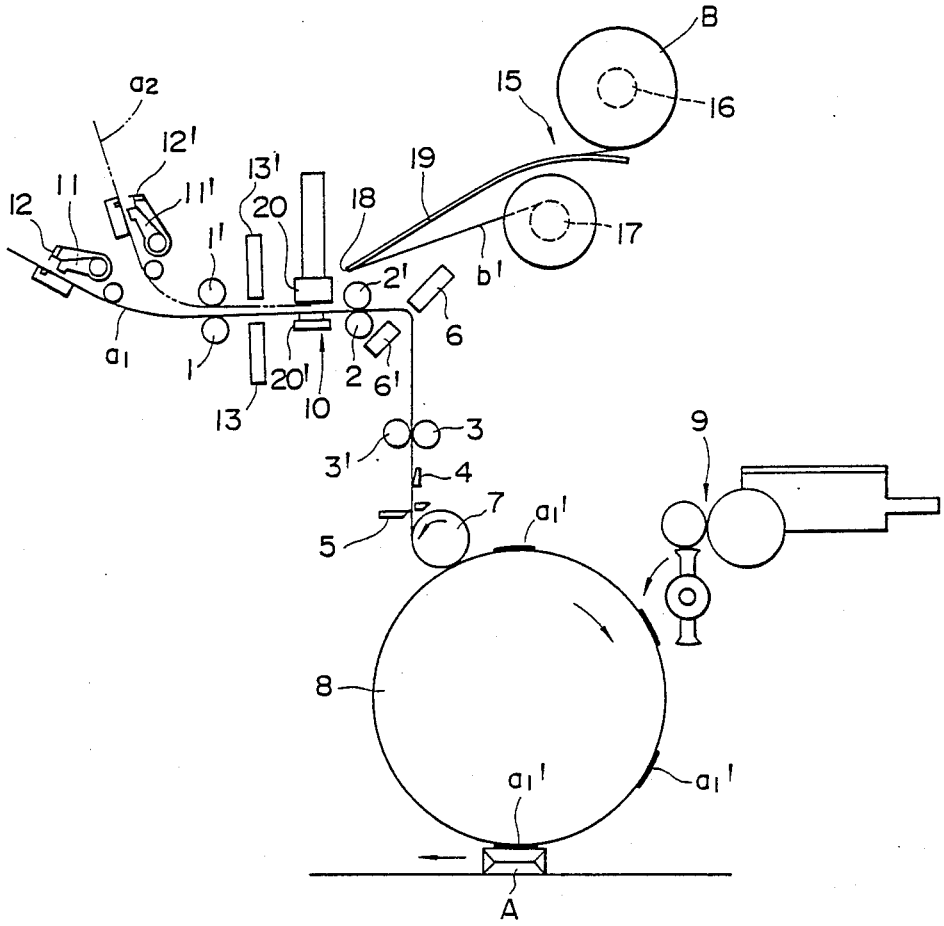
FIG. 1 is a schematic side view of an automatic connection system in accordance with the present invention showing a primary web being furnished to a packaging line.
Figure 3:
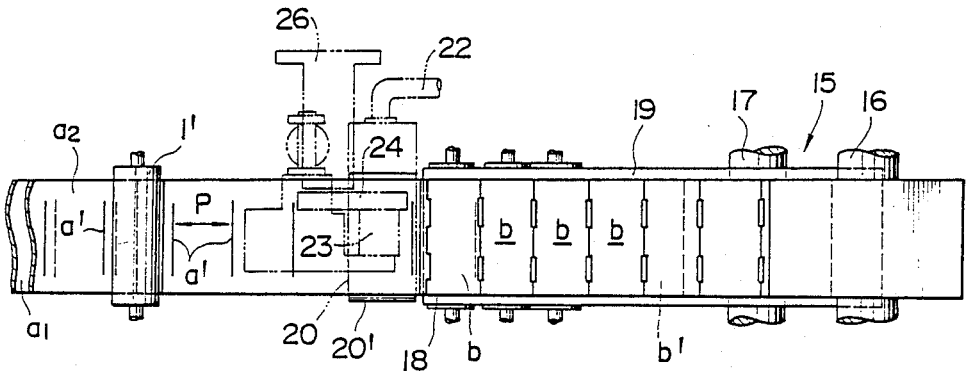
FIG. 3 is a top view of the apparatus shown in FIG. 2.

Referring now to FIG. 1 of the drawings, reference character $a_1$ designates a primary web derived from a first web supply such as a reel (not shown) on which the web is spooled which is to form, for example, a seal strip on cigarette package A that is part of a packaging line. Web $a_1$, after passing through cutter 12 (which is not yet actuated) and guide roller 1, passes between preliminary delivery rolls 2, 2' along a predetermined path that includes splicing station 10. Web $a_1$ is provided with a plurality of equally spaced transverse slits $a_1'$ (FIG. 3) spaced apart a distance P. Between these slits, a pattern may be printed or otherwise formed on the web at a predetermined location relative to adjacent slits.

After passing between main delivery rollers 3, 3', web $a_1$ is engaged by feed claw 4 for the purpose of intermittently moving the web along the predetermined path in a periodic manner. In this manner, web $a_1$ is periodically stationary for a predetermined period of time at the splicing station.

Downstream of feed claw 4, is cutter 5 which is arranged to cut the web, at the slits, into individual segments. These segments are releasably gripped by roller gripper 7, utilizing suction or the like, for transferring the segments, designated $a_1'$ to grip rotor 8. The grip rotor may be constructed in accordance with copending application Ser. No. 137,541 filed Dec. 22, 1987.

Grip rotor 8 rotates in the direction of the arrow shown in FIG. 1 past adhesive applicator 9 which applies adhesive to the exposed surface of each segment as the latter pass the applicator. Rotor 8 continues rotating and, in synchronism with a conveyor, applies a segment to each package A passing beneath rotor 8.

The present invention is concerned with splicing station 10 whereby replacement web $a_2$ is spliced to the trailing end of primary web $a_1$ when the supply of this web is exhausted. The operation of the splicing station is such that a butt joint is formed between the leading edge of replacement web $a_2$ and the trailing edge of web $a_1$ where the leading and trailing edges of the respective webs are located exactly one-half pitch from a slit in the respective webs. In this manner, a pattern contained within the pitch between the slits will be located properly on the segment severed by cutter 5 regardless of whether the segment is derived from primary web $a_1$ or replacement web $a_2$.

Figure 2:
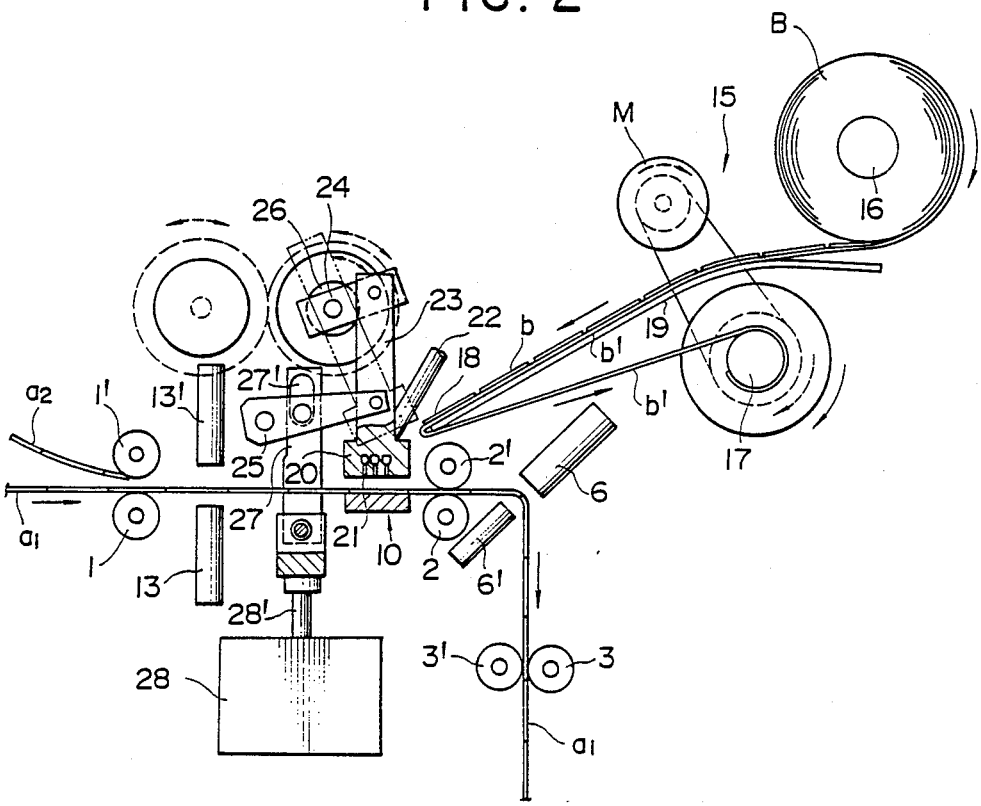
FIG. 2 is a side view, with some parts broken away to facilitate illustration of the invention, showing details of the automatic connection system of FIG. 1 at a stage just prior to the exhaustion of a reel containing the primary web being furnished to the packaging equipment.

Splicing station, which is located in the path traversed by web $a_1$ during the course of the intermittent operation of feed claw 4, comprises an articulated member in the form of arm 23 that carries block 20 at one end. Drive lever 24 mounted for pivotal movement about one end has its other end pivotally connected to the other end of arm 23 as shown in FIG. 2. Support lever 25 is pivotally mounted at one end and is pivotally engaged at the other end with arm 23 intermediate block 20 and the pivot connection with drive lever 24. Support rod 27 has slot 27' slidably engaged with a pin rigidly connected to support lever 25 for selectively imparting pivotal movement to the support lever in response to displacement of rod 28' connected to air cylinder 28. Drive lever 24 is rigidly connected to spur gear 26 which is capable of oscillation through a predetermined angle as indicated in FIG. 2 by selective oscillation of another gear that meshes with the spur gear.

When rod 28' is in its fully extended position (FIG. 4) and spur gear 26 has been rotated counterclockwise to its maximum position, arm 23 will be raised substantially from anvil 20' (FIG. 4) so that block 20 lies adjacent to guide 19 of splice supply 15. The splice supply includes reel B of splice strips b mounted on carrier web b'. Web b' is unspooled from reel B and passes in contact with guide 19 forming an acute angle as shown in FIG. 4 before being respooled on winder 17 operably connected to motor M.

Splice strips b are substrates having adhesive on one face and are releasably attached to carrier web b'. When motor M is powered, and winder 17 moves in a clockwise direction as seen in FIG. 4, carrier web b' is spooled onto the winder as the carrier web is unspooled from reel B.

Figure 4:
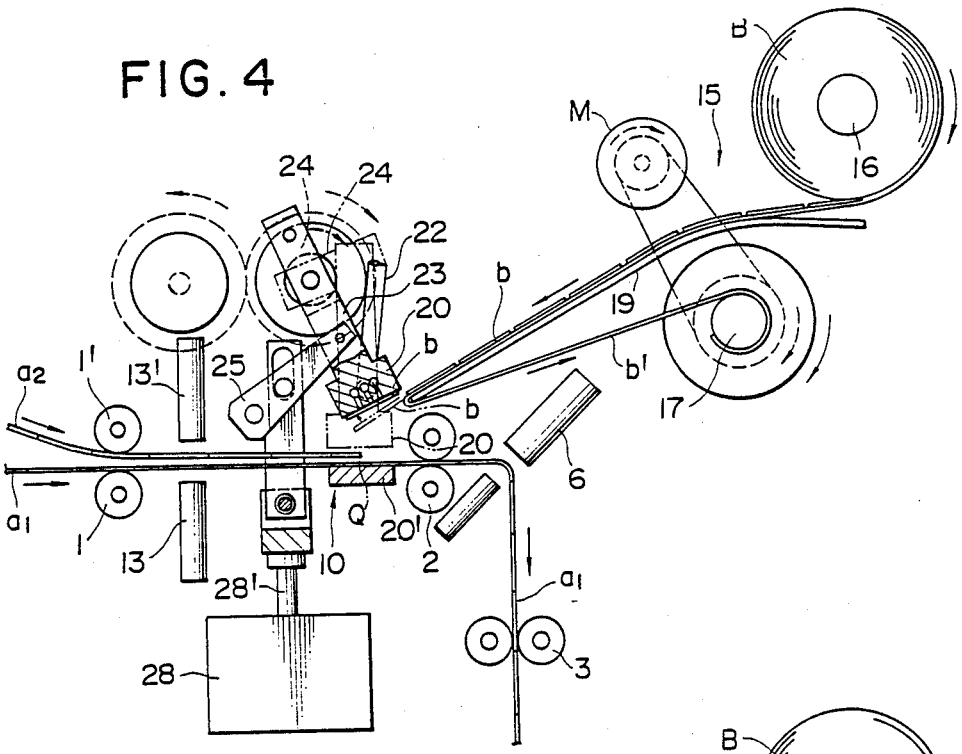
FIG. 4 is a side view of the apparatus shown in FIG. 2 except showing a transfer member in a position to accept a splice strip from a supply as the leading edge of a replacement web is about to be positioned in abutting relationship to the trailing edge of the primary web.

Because of the acute angle through which carrier web b' turns when passing the free end of guide 19, a splice strip b will be peeled from the carrier and will remain in the position shown in chain lines in FIG. 4 when the rotation of motor M ceases. The articulated member comprising arm 23 and block 20 will be in the position shown in FIG. 4 when actuator 28 fully extends rod 28' and pinion 26 is rotated as far clockwise as it will go. In this position, block 20 will be juxtaposed to the splice strip b projecting from web b' as shown in FIG. 4.

Figure 5:
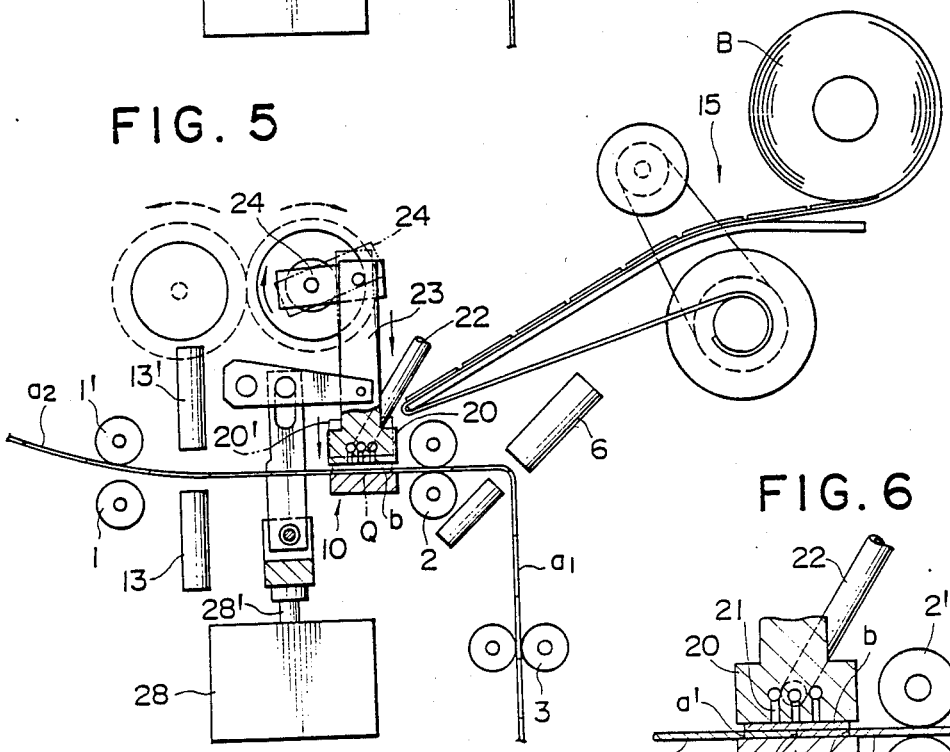
FIG. 5 is a view similar to FIG. 4 but showing the transfer mechanism applying the splice strip to the butt junction between the leading edge of the replacement web and the trailing edge of the primary edge.

Associated with block 20 is suction pipe 22 which applies a vacuum to a series of apertures 21 in block 20 thereby releasably gripping splice strip b. In this manner, a splice strip is plucked from carrier web b' in response to the detection of the trailing edge of web $a_1$. By causing pinion 26 to rotate clockwise to its furthest position, arm 23 is moved from the position shown in FIG. 4 to the position shown in FIG. 2 wherein block 20 is positioned opposite anvil 20' and spaced therefrom. By simultaneously operating actuator 28 to draw rod 28' inwardly, while at the same time imparting clockwise rotation to spur gear 26, block 20 is pressed toward anvil 20' as shown in FIG. 5. This movement will press splice strip b, releasably held by block 20, into engagement with the webs captured between block 20 and anvil 20' with the adhesive surface on the splice strip facing the captured webs. Thereafter, the vacuum in conduit 22 is released as actuator 28 moves rod 28' upwardly to the position shown in FIG. 2 which effectively moves arm 23 upwardly and spaces block 20 from anvil 20'.

Figure 6:
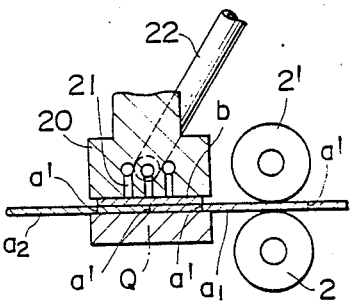
FIG. 6 is an enlarged view of the transfer mechanism showing the application of the splice seal to the butt connection between the two webs.

In operation, the incipient depletion of web $a_1$ from its supply may be sensed by detection of a suitable marker applied to the web near its connection to the reel, is accompanied by the operation of paper holder 11 and cutter 12 for the purpose of severing the trailing portion of web $a_1$ at a location halfway between adjacent slits a' in this web. This has the effect of establishing the trailing edge of web $a_1$. This trailing edge is designated by reference character Q (FIGS. 5 and 6). In timed relation to the creation of the trailing edge of web $a_1$, holder 11' and cutter 12' are also actuated for the purpose of severing the leading portion from replacement web $a_2$ at a position precisely between adjacent slits a'. This action establishes the leading edge of replacement web $a_2$. As indicated in FIG. 4, the leading edge of web $a_2$ is designated by reference character Q'.

As feed claw 4 continues to intermittently draw web $a_1$ through the splicing station, detector 13 eventually detects the trailing edge of this web. Upon detection of the trailing edge of web $a_1$, web $a_2$ is drawn from its supply reel into the splice station as indicated in FIGS. 2 and 4. Because of the precise positioning of web $a_1$ by reason of the operation of detectors 6, 6', the trailing edge of web $a_1$ will eventually arrive midway of anvil 20' and stop because of the intermittent nature of web movement caused by the operation of feed claw 4. While web $a_1$ is stationary, web $a_2$ is drawn into the splice station as shown in FIG. 4 until the leading edge thereof abuts the trailing edge of web $a_1$ as shown in FIG. 6. At that moment, actuator 28 is operated causing block 20 on arm 23 to press half of splice strip b onto web $a_1$ and the other half onto web $a_2$ as the butt joint between the two webs and the splice strip are captured between block 20 and anvil 20' as shown in FIGS. 5 and 6. The pressure created by the squeezing of the splice strip against the butt joint between the two webs adheres the seal strip to the butt joint thus effecting a splice between web $a_1$ and web $a_2$. Thereafter, actuator 28 is operated to extend support rod upwardly as shown in FIG. 2 and provide clearance for continued movement of the spliced web by the next movement of feed claw 4.

Continued operation of feed claw 4 is effective to draw web $a_2$ from its supply allowing a replacement supply to be substituted for the depleted supply of web $a_1$. When the supply of web $a_2$ is exhausted, a trailing edge on this web is established by operation of holder 11' and cutter 12', and a leading edge is established on the new replacement supply by the operation of holder 11 and cutter 12. The detection of the new trailing edge by detector 13' is then used to operate the splice station and enable another splice strip to be removed from carrier web b' in preparation for the next splice.

From the above description, it can be appreciated that the present invention provides apparatus for splicing a replacement web to a primary web having a programmed movement without interrupting such movement. That is to say, the intermittent movement of claw 4 continues according to its program is unaffected by the splicing operation that occurs in the interval when the web being pulled by the feed claw is stationary. Moreover, the present invention provides for establishing a butt splice joint precisely midway between a pattern so that half of a pattern is on one web and half of a pattern is on the other web at the splice connection. In this manner, the pattern in the replacement web will be in registration with the pattern in the original web; and only a single pattern need be removed to discard the butt joint when the web is severed by cutter 5. Consequently, the present invention provides considerably labor savings compared with the prior art and also improves the working efficiency and productivity of the packaging line.

It is believed that the advantages and improved results furnished by the method and apparatus of the present invention are apparent from the foregoing description of the preferred embodiment of the invention. Various changes and modifications may be made without departing from the spirit and scope of the invention as described in the claims that follow.

What is claimed is:

1. Apparatus comprising:

(a) a first web supply containing a first web and a second web supply containing a second web;

(b) operable pulling means engaged with said first web for withdrawing the same from said first supply and moving said first web along a predetermined path;

(c) cutter means for severing the first web to establish a trailing edge thereon, and for severing the second web to establish and a leading edge thereon;

(d) means for detecting the presence of said trailing edge on said path; and (e) a splicing station position in said path constructed and arranged to splice said leading edge of said second web to said trailing edge of said first web while each of said first and second webs lie in a common plane such that the leading edge of the second web abuts the trailing edge of the first web in response to detecting the presence of said trailing edge.

2. Apparatus according to claim 1 wherein said pulling means is constructed and arranged to move said first web such that the latter is periodically stationary for a predetermined time at said splicing station.

3. Apparatus according to claim 2 wherein said pulling means intermittently moves said first web in a periodic manner.

4. Apparatus according to claim 1 wherein each of said first and second webs have a pattern that repeats in the lengthwise direction of the web.

5. Apparatus according to claim 4 wherein said pattern includes slits that are transverse to the lengthwise direction of the webs.

6. Apparatus according to claim 5 wherein said pulling means includes a claw engaged with the slits in the web.

7. Apparatus according to claim 5 including a slit detector associated with said first web for detecting the location of a slit and controlling the position of a slit in the splicing station when the web is stationary therein.

8. Apparatus according to claim 1 wherein said splice includes a splice strip that overlies and is adhesively connected to both the first and second webs.

9. Apparatus according to claim 8 wherein said splice strip includes a substrate having a self-adhesive layer on one surface engaged with said webs.

10. Apparatus according to claim 1 wherein said splice station includes a splice supply containing a carrier web, one surface of which carries a plurality of splice strips that have self-adhesive on one face by which the strips are releasably attached to the carrier web, transfer means constructed and arranged to remove a strip from said carrier web and place the removed strip over the butt connection between the leading edge of the second web and the trailing edge of the first web with aid one face in contact with the two webs.

11. Apparatus according to claim 10 wherein said transfer means includes a take-up reel on which said carrier web is spooled after the splice strips are removed, a guide engaged with said carrier web effective to separate a splice strip from a portion of the carrier web when said portion engages the guide, and means to power said take-up reel in timed response to detection of said trailing edge of said first web for separating a splice strip from the carrier web.

12. Apparatus according to claim 11 wherein said transfer means includes a transfer mechanism having an articulated member constructed and arranged to releasably grip a splice strip separated from the carrier web and move the splice strip into engagement with the leading edge of the second web when it abuts the trailing edge of the first web such that the self-adhesive face of the splice strip faces the abutting webs.

13. Apparatus according to claim 12 wherein said transfer mechanism includes:

(a) an arm carrying a block at one end;

(b) a drive lever pivoted for pivotal movement about one end and having another end pivotally connected to the other end of said arm;

(c) a pivotally mounted support lever pivotally engaged with said arm intermediate said block and said other end of said arm;

(d) a support rod connected to said support lever for pivoting the same when said rod is moved; and (e) an actuator for moving the support rod in timed response to detection of the trailing edge of said first web.

14. Apparatus according to claim 13 herein said transfer means includes means for pivoting the drive lever in timed response to detection of the trailing edge of said first web.

15. Apparatus according to claim 4 wherein said cutter means are constructed and arranged such that the pattern at the trailing edge of said first web matches the pattern at the leading edge of said second web.

16. Apparatus according to claim 15 wherein said splice includes a splice strip that overlies and is adhesively connected at the butt joint between the trailing edge of the first web and the leading edge of the second web.

17. Apparatus according to claim 16 including means downstream of said splice station of severing said first web between patterns thereon to form severed segments containing said pattern.

18. Apparatus according to claim 1 including:

(a) a sticky strip feeding mechanism to feed a sticky strip to said splicing station;

(b) means for moving the leading edge of said second web into a predetermined position in said conveying passage;

(c) a connecting block movable toward said anvil upon actuation of said block in the conveying passage;

(d) said connecting block having means for releasably holding a strip; and (e) means for actuating the connecting block to adhere a sticky strip held on said block to the trailing edge of said first web and to the leading edge of said second web.

19. Apparatus according to claim 18 including cutter means for cutting each of the webs at a position midway of a pattern that repeats in the lengthwise direction of the webs, said connecting block being constructed and arranged to form a butt connection between the leading edge of the replacement belt and the trailing edge of the other belt so that the pattern matches at the butt connection.

20. Apparatus according to claim 1 wherein said transfer mechanism includes:

(a) an arm carrying a block at one end;

(b) a drive lever pivoted for pivotal movement about one end and having another end pivotally connected to the other end of said arm;

(c) a pivotally mounted support lever pivotally engaged with said arm intermediate said block and other end of said arm;

(d) a support rod connected to said support lever for pivoting the same when said rod is moved; and (e) an actuator for moving the support rod in timed response to detection of the trailing edge of said first web.

21. Apparatus according to claim 20 wherein said transfer means includes means for pivoting the drive lever in timed response to detection of the trailing edge of said first web.

* * * * *

UNITED STATES PATENT AND TRADEMARK OFFICE

CERTIFICATE OF CORRECTION

PATENT NO. : 4,878,982

DATED : November 7, 1989

INVENTOR(S) : T. OGATA et al.

It is certified that error appears in the above-identified patent and that said Letters Patent is hereby corrected as shown below:

Column 3, line 41, change "137,541" to —136,541—.
Column 3, line 61, insert —10— after "station".
Column 5, line 60, change "considerably" to —considerable—.
Column 6, line 13, delete "and".
Column 6, line 60, change "aid" to —said—.
Column 7, line 26, change "herein" to —wherein—.
Column 8, line 32, insert —said— before "other".

Signed and Sealed this

Thirtieth Day of July, 1991

*Attest:*

*Attesting Officer*

HARRY F. MANBECK, JR.

*Commissioner of Patents and Trademarks*